US009227822B2

(12) United States Patent
Horne

(10) Patent No.: US 9,227,822 B2
(45) Date of Patent: Jan. 5, 2016

(54) HEIGHT ADJUSTABLE SUPPORT ASSEMBLY

(75) Inventor: Desmond John Horne, Queensland (AU)

(73) Assignee: Mountain Angler Pty Ltd., Tennyson, Queensland (AU)

( * ) Notice: Subject to any disclaimer, the term of this patent is extended or adjusted under 35 U.S.C. 154(b) by 918 days.

(21) Appl. No.: 12/745,176

(22) PCT Filed: Nov. 27, 2008

(86) PCT No.: PCT/AU2008/001772

§ 371 (c)(1),
(2), (4) Date: Sep. 13, 2010

(87) PCT Pub. No.: WO2009/067762

PCT Pub. Date: Jun. 4, 2009

(65) Prior Publication Data

US 2010/0325797 A1 Dec. 30, 2010

(30) Foreign Application Priority Data

Nov. 27, 2007 (AU) ..... 2007906461

(51) Int. Cl.

| | |
|---|---|
| ***A47B 7/00*** | (2006.01) |
| ***B66F 7/06*** | (2006.01) |
| ***A61G 13/06*** | (2006.01) |
| ***A61G 15/02*** | (2006.01) |
| *A61G 7/012* | (2006.01) |

(52) U.S. Cl.

CPC ..... *B66F 7/0691* (2013.01); *A61G 13/06* (2013.01); *A61G 15/02* (2013.01); *A61G 7/012* (2013.01)

(58) Field of Classification Search

CPC ..... B66F 7/0691; A61G 13/06; A61G 15/02; A61G 7/012

USPC ..... 5/11, 611; 108/99, 116, 118–120, 145, 108/147.22

See application file for complete search history.

(56) References Cited

U.S. PATENT DOCUMENTS

| | | | | |
|---|---|---|---|---|
| 2,299,136 | A * | 10/1942 | Feldman | 5/11 |
| 2,364,577 | A * | 12/1944 | Webb | 5/11 |
| 2,874,805 | A | 2/1959 | Jahnel | |
| 3,626,522 | A | 12/1971 | van der Meij | |
| 4,273,306 | A * | 6/1981 | Chang | 248/421 |
| 4,405,116 | A | 9/1983 | Eisenberg | |

(Continued)

FOREIGN PATENT DOCUMENTS

| | | |
|---|---|---|
| CN | 2424765 | 3/2001 |
| DE | 1969242 U | 9/1967 |

(Continued)

*Primary Examiner* — David E Sosnowski

(74) *Attorney, Agent, or Firm* — Schwabe, Williamson & Wyatt

(57) ABSTRACT

A support assembly (10) optionally for supporting a patient during an operation or surgical procedure having an upper platform (11); a base structure (13); and a height adjustment mechanism which includes a pair of legs (14, 15) wherein each leg (14, 15) is located at opposed ends of the upper platform (11) and is pivotally attached thereto and is also pivotally attached to the base structure (13) and a pair of control links (40, 41) wherein each control link (40, 41) is pivotally attached to an adjacent leg (14, 15) intermediate its height and also pivotally attached to the base structure (13) characterised in that a lower end of each leg (14, 15) is movably mounted in an associated guide track (50, 51) or guide tracks (50, 51) located on the base structure (13).

16 Claims, 8 Drawing Sheets

(56) References Cited

U.S. PATENT DOCUMENTS

| | | | | |
|---|---|---|---|---|
| 4,582,310 | A | 4/1986 | Hahn | |
| 4,658,735 | A | 4/1987 | Holton | |
| 4,792,272 | A | 12/1988 | Oswald et al. | |
| 5,450,928 | A * | 9/1995 | Isogai | 187/205 |
| 5,562,051 | A | 10/1996 | Rizzi | |
| 5,632,209 | A | 5/1997 | Sakakibara | |
| 5,636,578 | A | 6/1997 | Rizzi | |
| 5,727,655 | A * | 3/1998 | Pitman | 187/211 |
| 6,654,973 | B2 | 12/2003 | Van Den Heuvel et al. | |
| 7,703,157 | B2 * | 4/2010 | Dorenbeck | 5/611 |
| 8,015,638 | B2 * | 9/2011 | Shimada et al. | 5/611 |
| 8,176,584 | B2 * | 5/2012 | Hornbach et al. | 5/601 |
| 8,256,048 | B2 * | 9/2012 | Bly et al. | 5/627 |
| 2003/0079288 | A1 * | 5/2003 | Cook et al. | 5/611 |
| 2008/0086816 | A1 * | 4/2008 | Farooqui | 5/601 |
| 2010/0325797 | A1 * | 12/2010 | Horne | 5/611 |

FOREIGN PATENT DOCUMENTS

| | | | |
|---|---|---|---|
| DE | 3340883 | A1 | 5/1985 |
| DE | 19925340 | A1 | 12/2000 |
| DE | 20107616 | U1 | 1/2002 |

* cited by examiner

HEIGHT ADJUSTABLE SUPPORT ASSEMBLY

CROSS REFERENCE TO RELATED APPLICATIONS

The present application is a national phase entry of, and claims priority under 35 U.S.C. §120 to, International Patent Application No. PCT/AU2008/001772, filed 27 Nov. 2008, entitled "Height Adjustable Support Assembly" also known as "Support Assembly," which designates the United States of America and which claims priority to Australian Patent Application No. 2007906461, filed 27 Nov. 2007, entitled "Support Assembly," the entire content and disclosure of which is hereby incorporated by reference in its entirety.

This invention relates to a support assembly and in particular to a support assembly such as a table, bed or chair which may be used for supporting patients when undergoing an operation or surgical procedure. However, it will be appreciated that the invention should not be limited to this particular application.

Conventional patient support assemblies used in podiatry, dentistry or for surgical procedures usually have a base support having attached thereto caster wheels or swivel feet and a bed, chair or table which is attached to the base support by a height adjustment mechanism including a pivot assembly which normally comprises a scissor linkage having a pair of lever arms attached to each other at their approximate midpoint. Movement of the scissor linkage may be actuated by a pneumatic ram assembly. An example of such a support assembly is described in U.S. Pat. No. 6,654,973. An alternative height adjustment mechanism in everyday use is a telescopic mechanism also controlled by a pneumatic ram assembly.

Reference may also be made to U.S. Pat. No. 5,632,209 which describes a lift table that consists of a base and a table attached to the base by a pair of scissor links. The table is raised by a height adjustment mechanism comprising a compression spring.

Reference also may be made to U.S. Pat. No. 5,636,578 which refers to a folding table having a tabletop and a pair of opposing folding leg assemblies. Each leg assembly includes a pair of folding legs and each folding leg has a support plate secured to the tabletop. Each folding leg is pivotally connected to the support plate by a linkage arrangement that includes a first link that defines first and second axes of rotation and a second link that defines third and fourth axes of rotation. Each of the folding legs requires a latch to hold the folding leg in the extended or folded position.

Reference may also be made to U.S. Pat. No. 4,658,735 that describes a heavy duty folding table having a pair of pedestal legs wherein the upper end of each leg is pivotally attached to the frame of the table. To each leg is attached a T shaped brace wherein the leg portion of the brace is pivotally connected to a pedestal leg. The cross pieces of the braces extend between the table frame and are pivotally attached thereto. The two pedestal legs are independently foldable and unfoldable which can be done by one person. When in the folded condition the T shaped braces lie parallel to and between the tabletop and pedestal legs.

Reference also may be made to U.S. Pat. No. 4,582,310 which describes an X-ray examination table having a trestle on which a patient support platform is height adjustably mounted wherein the trestle has a liftable member being connected to a base by a pair of brackets pivotally connected to each other and having one of the pair being pivotally connected to the liftable member and the other being pivotally connected to the base.

The prior art discussed above is therefore characterised by being complicated in regard to the height adjustment mechanism such as that described in U.S. Pat. Nos. 4,852,310, 4,658,735 and 5,562,051 or requiring the use of a latch such as described in U.S. Pat. No. 5,636,578 which also has a complicated folding mechanism. Another problem with the conventional folding tables having a height adjustment mechanism using a scissor or X linkage or a telescopic arrangement was that such folding tables were relatively cumbersome and occupied a relatively large space when being stored or transported.

It is therefore an object of the present invention to provide a support assembly which is efficient in operation and has a simple structure.

The support assembly of the invention has:

(i) an upper platform;

(ii) a base structure; and (iii) a height adjustment mechanism which includes a pair of legs wherein each leg is located at opposed ends of the upper platform and is pivotally attached thereto and is also pivotally attached to the base structure and a pair of control links wherein each control link is pivotally attached to an adjacent leg intermediate its height and also pivotally attached to the base structure characterised in that a lower end of each leg is movably mounted in an associated guide track or guide tracks located on the base structure.

Preferably there is provided drive means for each of the legs so that the lower end of each leg may be moved in its associated guide track. Such drive means may be common to each leg or individual drive means may be used in regard to each leg. To this end lower end of the each leg may be provided with a movable block which is movable in its respective guide track and the movable block may be slidable in its associated guide track or be mounted therein for functional engagement.

The drive means may be of any suitable type such as use being made of a lead screw and travelling nut arrangement which may be driven by separate motors wherein individual drives are required or by a single motor wherein a common drive is required. In the latter arrangement each of the lead screws may be connected by a pair of gears at an end remote from the drive motor.

Use may also be made of a sprocket and chain arrangement where a chain, belt or cable is attached to a sprocket or idler pulley at each end and the movable block is attached to the chain, belt or cable. The chain, belt or cable may be driven by a drive motor and again a common drive may be employed wherein each movable block is attached to separate runs of each chain, belt or cable or alternatively individual drives may be utilised wherein a pair of drive motors are used to drive a separate chain, belt or cable supported on end sprockets or pulleys.

The upper platform may be of any suitable type and thus comprise a tabletop, chair, seat or bed as may be required. The base structure is preferably hollow so as to accommodate the drive means discussed above.

Reference may be made to a preferred embodiment of the invention as shown in the drawings wherein.

Figure 1:
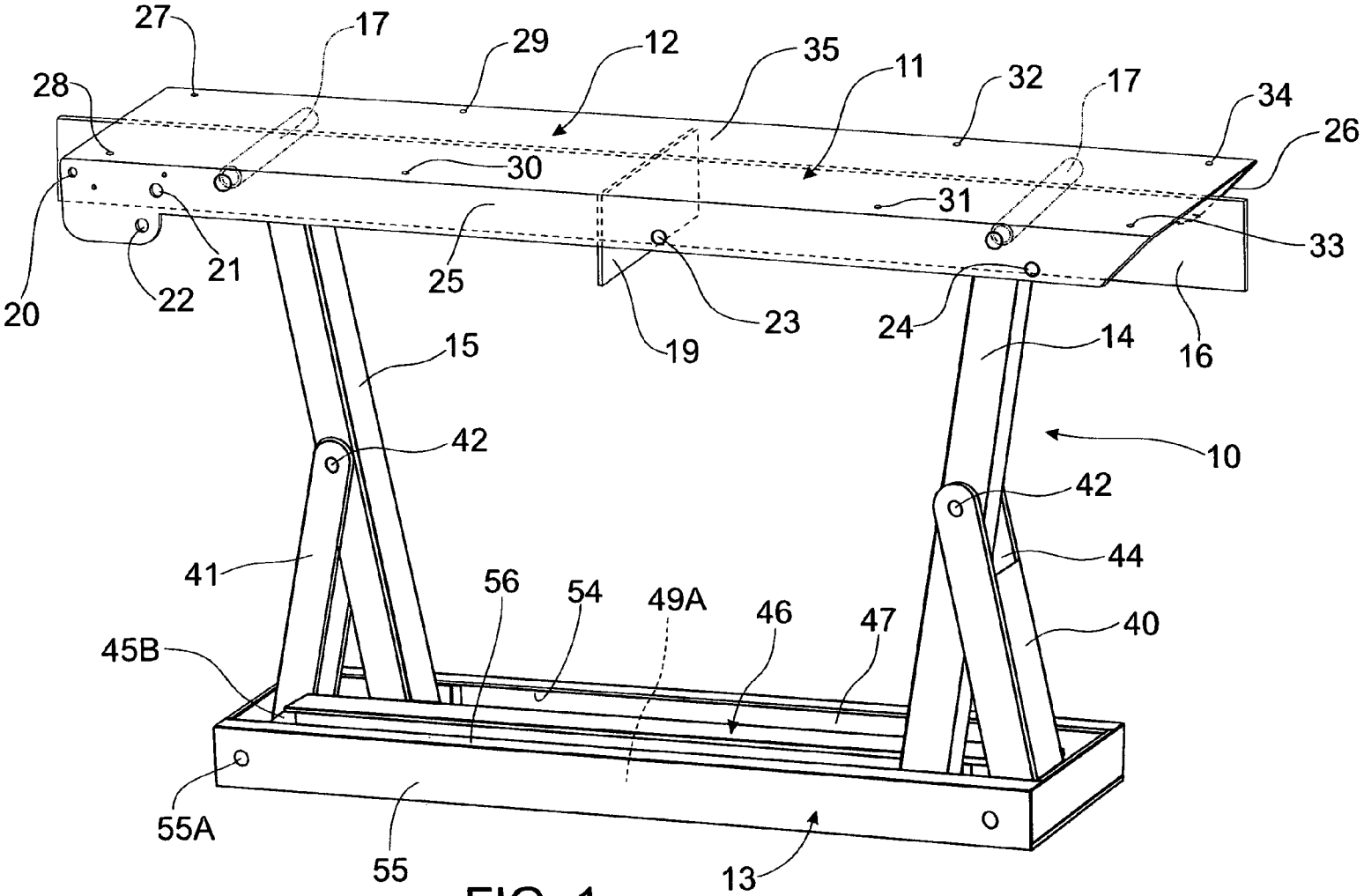
FIG. 1 is a perspective view of the support assembly of the invention.

In FIG. 1 of the drawings there is shown support assembly 10 in the form of an upper platform 11 which may constitute a tabletop 12 which is supported by a base structure 13 and a pair of legs 14 and 15 wherein the top end of each leg 14 and 15 is pivotally supported by an associated pivot pin 17 shown in phantom in FIG. 1 which engages with frame member 16 which is aligned longitudinally of tabletop 12 and attached to its underside by appropriate means (not shown) e.g. by welding. There is also provided transverse reinforcement plate 19 which extends across frame member 16 as shown as well as attachment apertures 20, 21, 22, 23 and 24 located in each flange 25 and 26 of tabletop 12 as well as attachment apertures 27, 28, 29, 30, 31, 32, 33 and 34 located in top wall or surface 35 of tabletop 12. Each of these attachment apertures may be used to attach an upholstery frame (not shown) to tabletop 12.

There is also shown in FIG. 1 pivot links 40 and 41 which are pivotally attached to each leg 14 and 15 by pivot pins 42. Each of pivot links 40 and 41 are pivotally attached to associated pivot pins 45A and 45B as best shown in FIG. 2.

Figure 2:
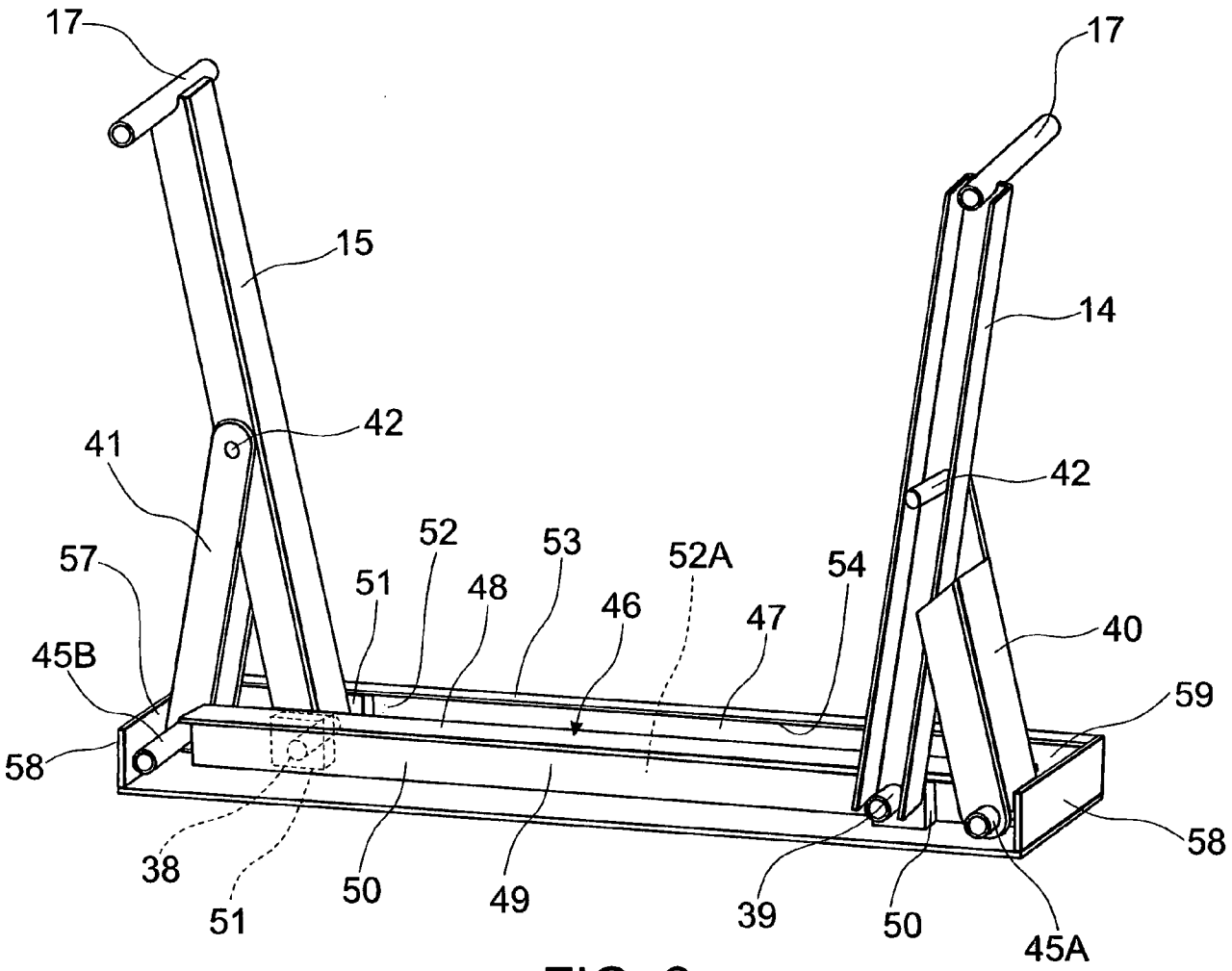
FIG. 2 is a similar view of FIG. 1 with part of the base structure removed and the top support platform removed for the sake of clarity.

The base structure 13 is in the form of a shallow box as shown in FIGS. 1 to 2 and has a central longitudinal I shaped beam 46 located in hollow interior 47 of base structure 13 which has a top plate 48 which defines a track 49 in combination with vertical plate 50 of beam 47. Leg 14 has a pair of bottom slide blocks 50A which each move or slide in an adjacent track 49 and another track 49A formed by side wall 55 and flange 56 shown in FIG. 1. Leg 14 also has a bottom pivot pin 39. In similar fashion leg 15 is provided with a pair of bottom slide blocks 51 which each move or slide in an adjacent track 52 formed by flange 53 of base member 13 and side wall 54 of base member 13 and another track 52A formed by top plate 48 and vertical plate 50. Leg 15 also has an associated pivot pin 38. It will also be noted that pivot pin 45B engages in side wall 55 of base member 13 at 55A as well as side wall 54 and extends through a gap 57 between an adjacent end wall 58 of base member 13 and an adjacent end of beam 46. In similar manner pivot pin 45A extends through a similar gap 59 and also engages with each side wall 54 and 55.

Each of legs 14 and 15 are of channel shape as shown and each of pivot links 40 and 41 are also of channel shape as shown in FIG. 2.

Figures 3, 4:
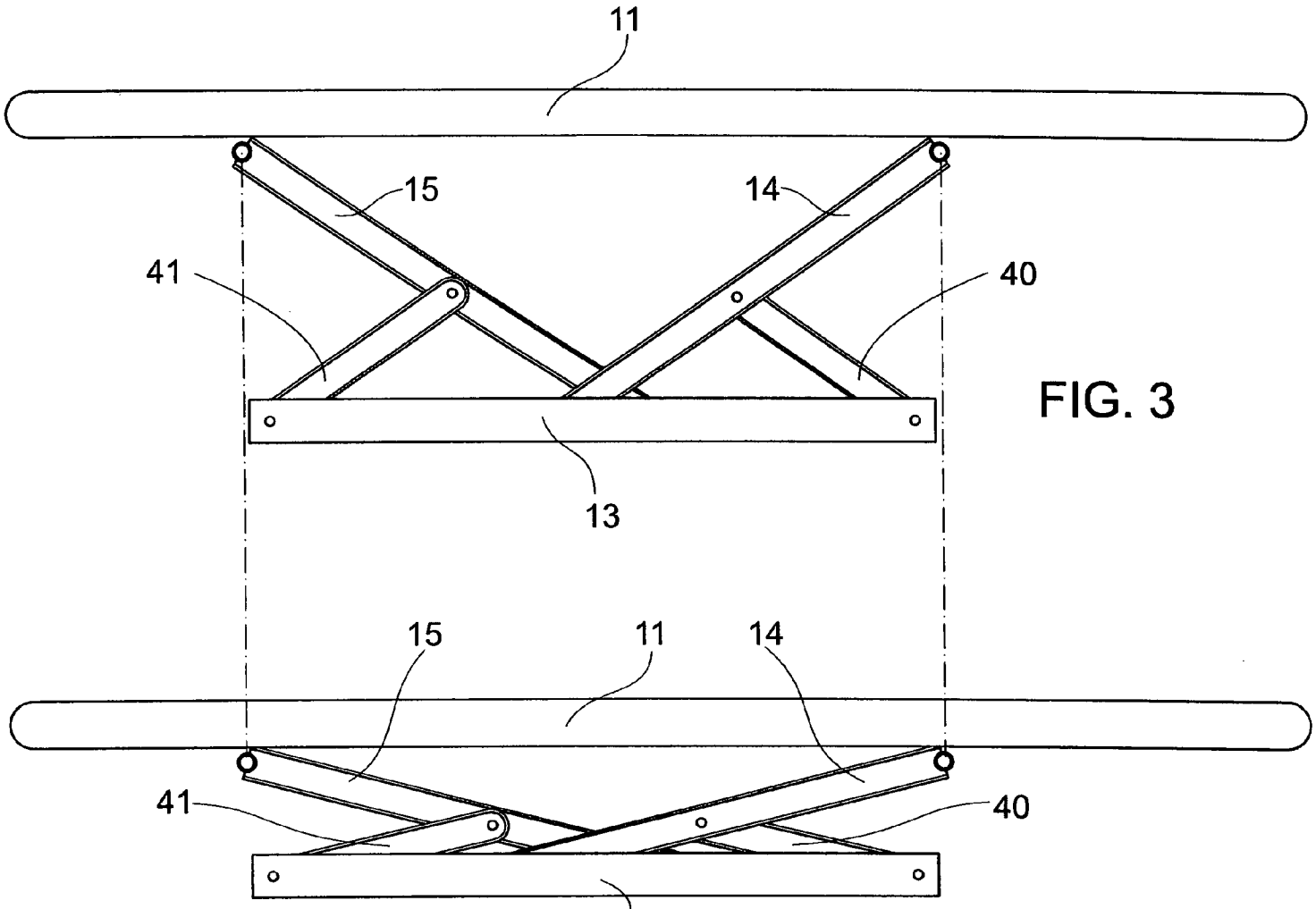
FIGS. 3 to 4 show the folding action of the top support platform relative to the base structure (i) at a stage intermediate the maximum height of the support platform and (ii) at a stage where the support platform is at its minimum height relative to the base support.

In FIGS. 3 to 4 there is shown the support platform 11 being moved in relation to base member 13 by pivoting of legs 14 and 15 and also by pivoting of pivot links 40 and 41 as shown. FIG. 3 shows the location of support platform 11 at a position intermediate its full height as shown in FIG. 1 and at its lowest height relative to base member 13 as shown in FIG. 4. FIG. 1 shows the position of maximum height of upper platform 11 wherein each leg 14 and 15 is located adjacent a respective end 58 of base structure 13. In contrast in FIG. 14 each end 14 and 15 is located substantially centrally of base structure 13. Thus, in FIG. 4 each leg 14 and 15 moves towards an opposite or remote and of base structure 13.

Figure 5:
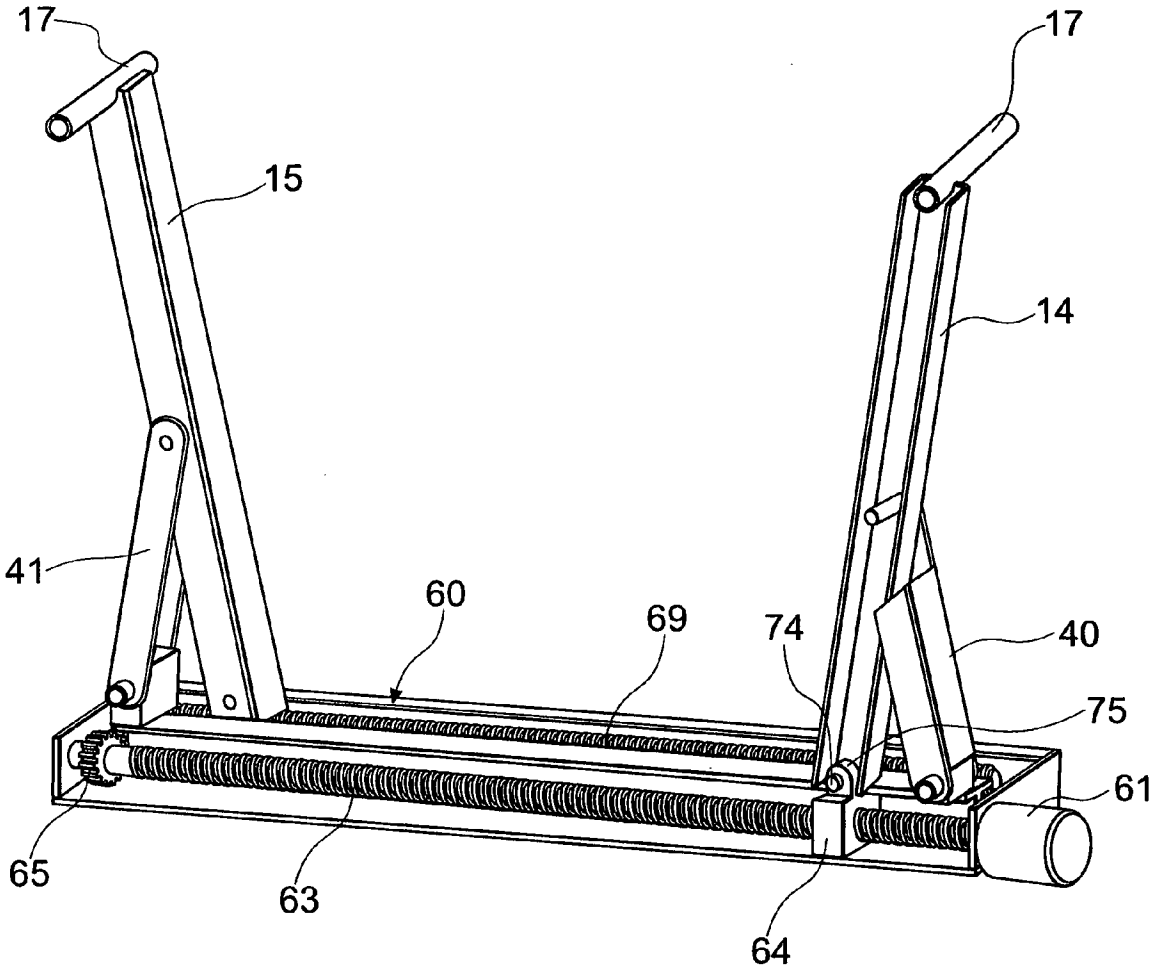
FIG. 5 is a perspective view of the support assembly showing one form of drive means for causing movement of the support platform relative to the base member.
Figure 6:
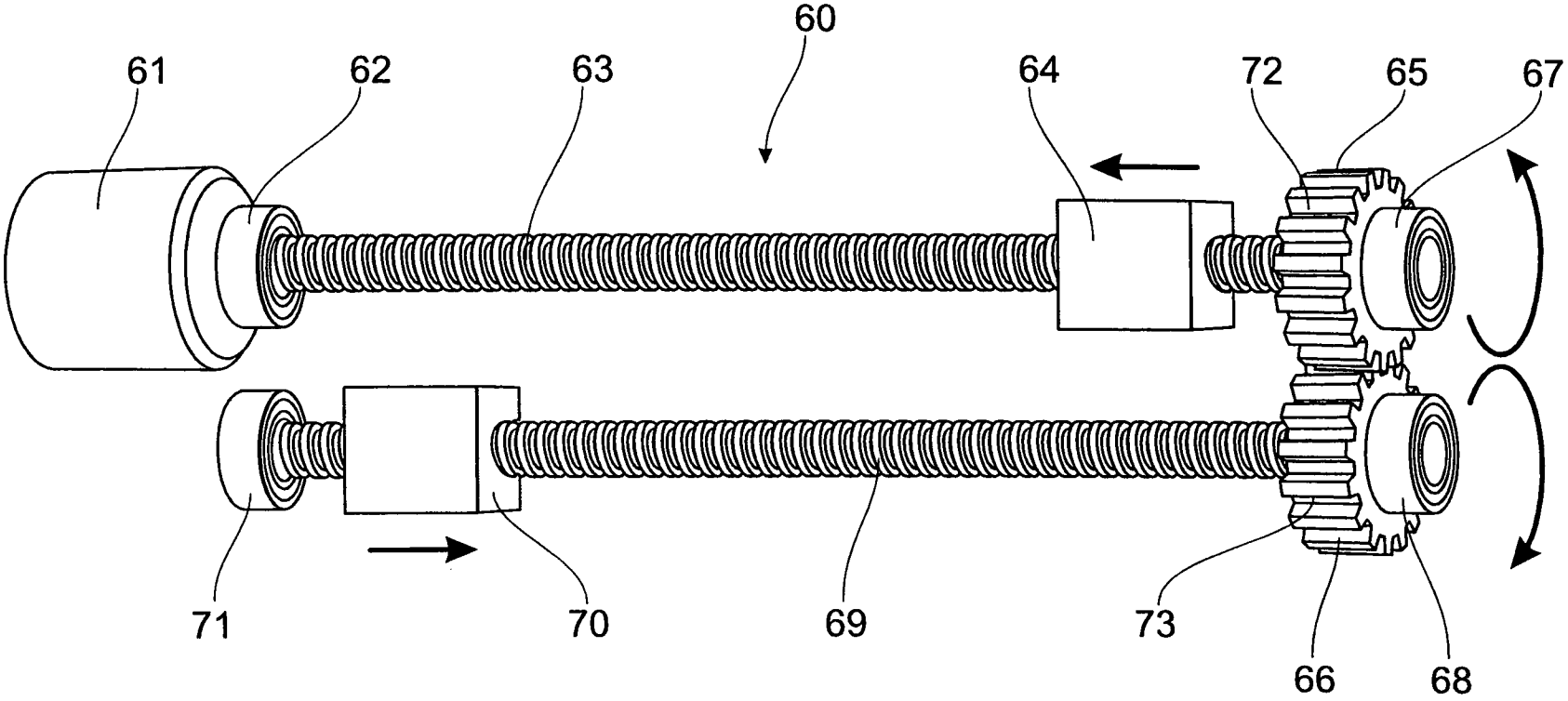
FIG. 6 is a more detailed view of the drive means shown in FIG. 5.

While it is possible in some cases to move legs 14 and 15 and pivot links 40 and 41 manually it is preferred to use a suitable drive means such as that shown in FIGS. 5 to 6. This drive means 60 includes an electric motor 61, bearing 62, lead screw 63, linear element or engagement or traveller nut 64, opposed gears 65 and 66, bearings 67 and 68, lead screw 69, linear element or engagement nut 70 and bearing 71. It thus will be noted, that upon rotation of lead screw 63 by electric motor 61 engagement nut or traveller nut 64 is caused to move in the direction shown by the arrow. Rotation of gear 65 causes rotation of gear 66 as shown by meshing of gear teeth 72 and 73. This in turn cases rotation of lead screw 69 which in turn causes linear movement of engagement nut or traveller nut 70 in the direction shown by the arrow.

In FIG. 5 leg 14 is attached to traveller nut 64 by bolt 74 passing through clevis 75. Leg 15 is attached to traveller nut 70 in a similar manner.

Figure 7:
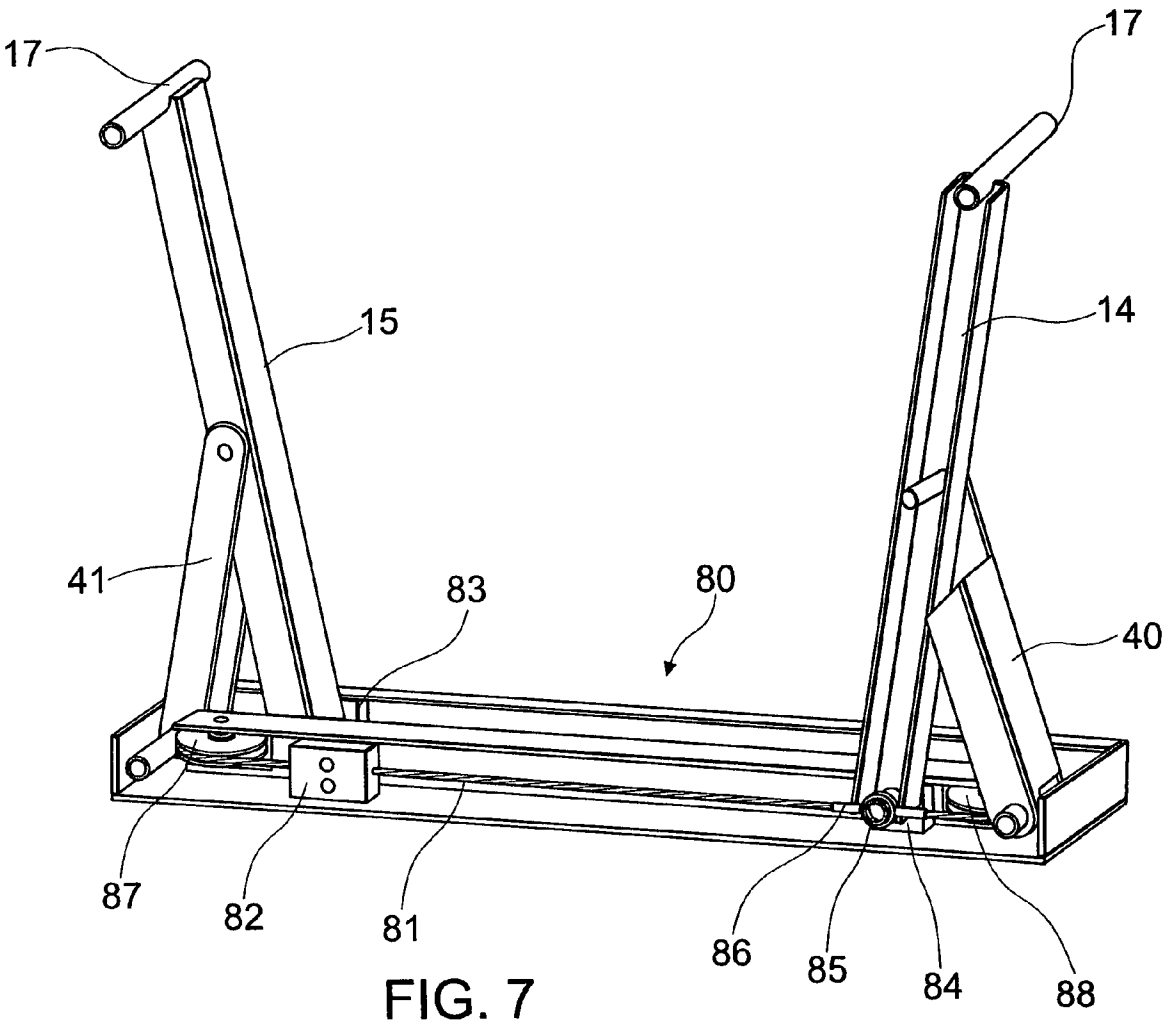
FIG. 7 is a schematic view showing the method of operation of the drive means shown in FIG. 5.
Figure 8:
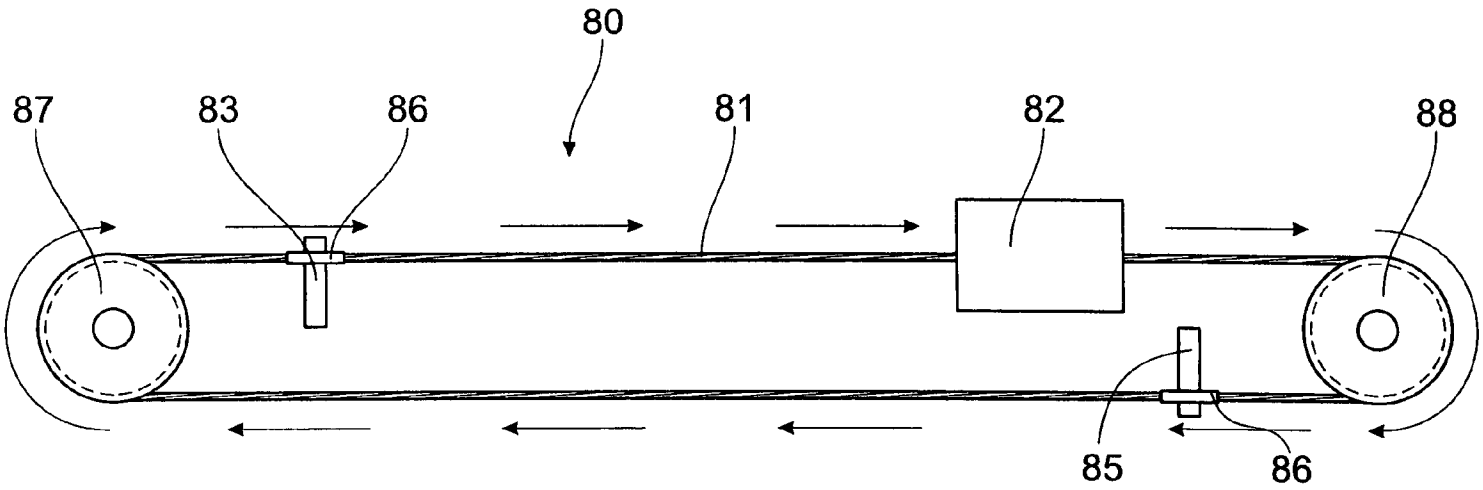
FIG. 8 is a perspective view of the support assembly showing another form of drive means in moving the support platform relative to the base structure.
Figure 9:
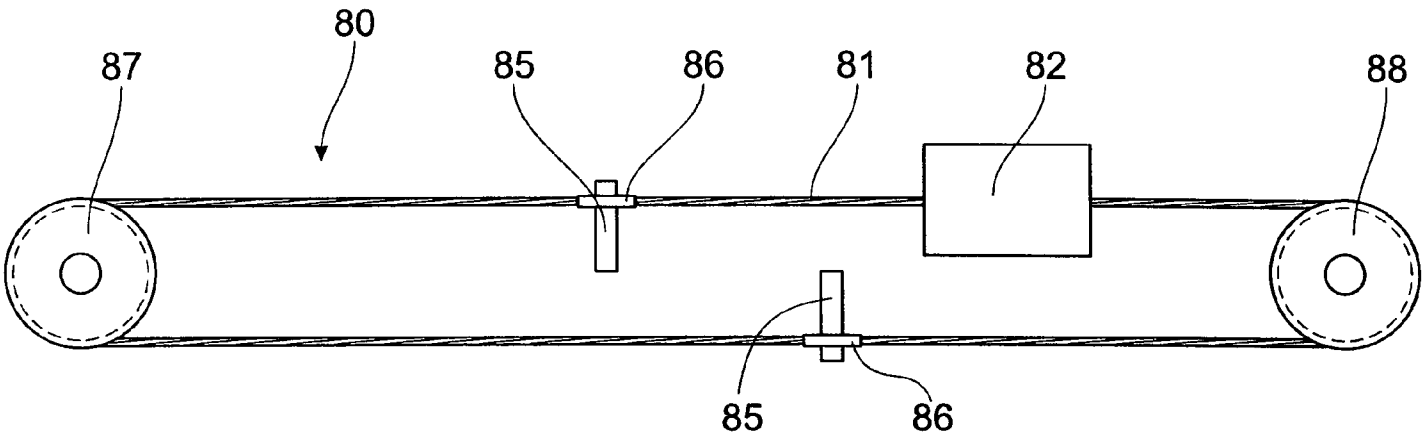
FIG. 9 is a schematic view of the drive means used in FIG. 8.

Reference is made in FIGS. 7 to 9 to an alternative drive means for initiating movement of legs 14 and 15. This drive means 80 includes cable or belt 81 which is driven by electric motor 82 in the direction indicated by arrows in FIG. 8. There is also provided attachment pins 83 and 85 which are each attached to an adjacent leg 14 and 15 as shown in FIG. 7 wherein leg 14 is attached to cable 81 by attachment block 84, attachment pin or bolt 85 and fastener 86. There are also provided sprockets 87 and 88 for engaging with cable 81 as shown.

Figures 10, 11:
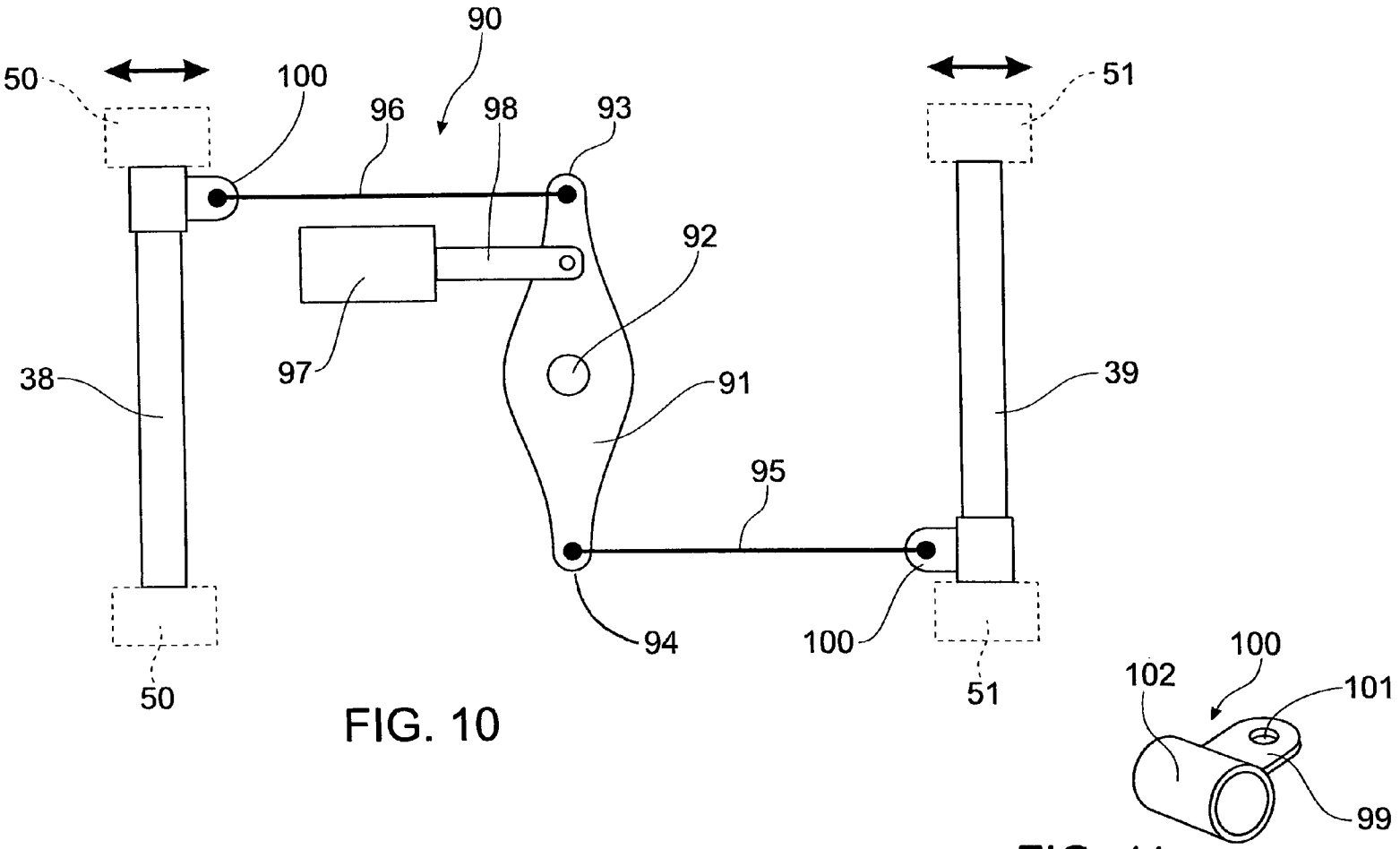
FIG. 10 shows an alternative embodiment of a drive means for initiating movement of the support platform relative to the base member.
FIG. 11 is a view of an attachment joint used in the embodiment of FIG. 10.

In FIG. 10 there is shown an alternative drive means 90 for moving the support platform 11 relative to the base structure 13. In this embodiment instead of the arrangement shown in FIG. 2 each of pivot pins 38 and 39 and their associated pair of slide blocks 50 and 51 move in a reciprocatable fashion as shown by the arrows in FIG. 10 to initiate movement of legs 14 and 15. Thus, there is provided a central link 91 pivotally supported by pivot joint 92 which is attached to base structure 13 and which has a rhombus shape which has opposed ends 93 and 94 which are attached to chains 95 and 96 to initiate movement of pivot pins 38 and 39 and their associated slide blocks 50 and 51. Central link 91 undergoes reciprocatable movement as it is connected to motor 97 by drive shaft 98 to cause simultaneous inward movement of pivot pin 38 and 39 or simultaneous outward movement of pivot pin 38 and 39 as shown by the arrows. Each of pivot pins 38 and 39 may be attached by joint 100 having a lug 99 with an attachment aperture 101 for connection to chains 95 and 96 and a tubular portion 102 which engages with pivot pin 38 and 39. Joint 100 is better shown in FIG. 11.

It will also be noted that each control link 40 and 41 is located outwardly (i.e. nearer an adjacent end of base structure 13 of an associated leg 14 or 15. Thus, movement of each leg 14 or 15 is always directed inwardly of its associated control link 40 or 41.

It will be appreciated from the foregoing that the support assembly 10 of the invention is based on a very simple height adjustment mechanism which enables the support assembly 10 to be stored or packed in limited storage space. The use of drive means 60 or 80 provides a control mechanism which is very easy to operate and obviates the need for a latch as the minimum height shown in FIG. 1 is controlled by the drive means. This also overcomes the need for complicate linkage assemblies as shown in the prior art.

The invention claimed is:

1. A support assembly comprising:

(i) an upper platform;

(ii) a base structure; and (iii) a height adjustment mechanism which includes:

a single pair of legs wherein each leg is located at generally opposed ends of the upper platform, each leg is pivotally attached to the upper platform, and each leg is pivotally attached to the base structure by a respective moveable pivot point located at an adjacent end of the base structure when the upper platform is at a maximum height, and a single pair of control links, each control link including a first end pivotally attached to a respective adjacent leg of the single pair of legs intermediate its height, and each control link including a second end pivotally attached to a respective fixed pivot point which is located on the base structure; wherein a lower end of each of the pair of legs is moveably mounted in one or more associated guide tracks;

each leg is moveable in separate one or more guide tracks and independently of each other so that respective bottom ends thereof move past each other in use; and each leg is located proximate a central vertical plane extending along and passing through a longitudinal axis of the upper platform such that one leg is located to one side of the central vertical plane and another leg is located to another side of the central vertical plane.

2. A support assembly as claimed in claim 1, wherein each of the control links is located outwardly of a respective adjacent leg and movement of each of the pair of legs is always directed inwardly of a respective control link.

3. A support assembly as claimed in claim 1, wherein the lower end of each of the pair of legs is provided with a slide block which is movable in the separate one or more associated guide tracks.

4. A support assembly as claimed in claim 1, wherein the lower end of each of the pair of legs is provided with a pair of slide blocks each of which are movable in an adjacent guide track.

5. A support assembly as claimed in claim 4, further comprising a drive means for moving said pair of slide blocks of each of the legs in their adjacent guide tracks.

6. A support assembly as claimed in claim 1, wherein the lower end of each of the legs is driven by a drive means for moving each lower end in the one or more associated guide tracks.

7. A support assembly as claimed in claim 6, wherein said drive means moves each of the legs from an adjacent end of the base structure which corresponds to a position of maximum height of the upper platform relative to the base structure towards an opposite end or substantially centrally of the base structure which corresponds to a position of minimum height of the upper platform relative to the base structure.

8. A support assembly as claimed in claim 6, wherein the drive means is a drive motor which is common to both of the pair of legs.

9. A support assembly as claimed in claim 6, wherein the drive means is a drive motor driving a sprocket and chain arrangement wherein the chain is attached to a sprocket at each end of the base structure and a respective slide block is attached to the chain.

10. A support assembly as claimed in claim 6, wherein the drive means is a drive motor driving a belt or cable wherein the belt or cable is attached to an idler pulley at each end of the base structure and a respective slide block is attached to the belt or cable.

11. A support assembly as claimed in claim 9, wherein said drive motor is a common drive for each of the pair of legs wherein each slide block is attachable to separate runs of the chain.

12. A support assembly as claimed in claim 10, wherein said drive motor is a common drive for each of the pair of legs wherein each slide block is attachable to separate runs of the belt or cable.

13. A support assembly as claimed in claim 1, wherein in a position of maximum height of said upper platform relative to the base structure each of the pair of legs is angled inwardly at an acute angle relative to vertical and each of said control links are located outwardly of a respective leg.

14. A support assembly as claimed in claim 1 wherein a first leg, of the single pair of legs, is attached to a first control link, of the single pair of control links;

the first leg is associated with a first guide track of the one or more associated guide tracks;

a first vertical plane extends along a first longitudinal axis of the first guide track; and the first leg, the first control link and the first longitudinal axis of the first guide track are aligned in the first vertical plane.

15. A support assembly for supporting a patient during an operation or a surgical procedure having:

(i) an upper platform;

(ii) a base structure;

(iii) a height adjustment mechanism which includes:

a single pair of legs wherein each leg is located at opposed ends of the upper platform and each leg is pivotally attached to the upper platform and each leg is also pivotally attached to the base structure, and a single pair of control links, each control link including a first end pivotally attached to a respective adjacent leg of the single pair of legs intermediate its height, and each control link including a second end pivotally attached to the base structure; wherein a lower end of each leg is movably mounted in an associated guide track located on the base structure;

each leg is moveable in a separate guide track independently of each other so that they move past each other in use; and each leg is located proximate a central vertical plane extending along and passing through a longitudinal axis of the upper platform such that one leg is located to one side of the central vertical plane and another leg is located to another side of the central vertical plane;

(iv) drive means for driving movement of each leg from an adjacent end of the base structure which corresponds to a position of maximum height of the upper platform relative to the base structure towards an opposite end of the base structure which corresponds to a position of minimum height of the platform relative to the base structure.

16. A support assembly as claimed in claim 15 wherein a first leg, of the single pair of legs, is attached to a first control link, of the single pair of control links;

the first leg is associated with a first guide track of the one or more associated guide tracks;

a first vertical plane extends along a first longitudinal axis of the first guide track; and the first leg, the first control link and the first longitudinal axis of the second guide track are aligned in the first vertical plane.

* * * * *